US010294551B2

(12) United States Patent
Oka et al.

(10) Patent No.: US 10,294,551 B2
(45) Date of Patent: May 21, 2019

(54) HIGH-STRENGTH LOW-SPECIFIC-GRAVITY STEEL SHEET HAVING SUPERIOR SPOT WELDABILITY

(71) Applicant: NIPPON STEEL & SUMITOMO METAL CORPORATION, Tokyo (JP)

(72) Inventors: Masaharu Oka, Himeji (JP); Nobuhiro Fujita, Tokai (JP); Manabu Takahashi, Kisarazu (JP); Riki Okamoto, Kobe (JP); Chisato Wakabayashi, Kimitsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 434 days.

(21) Appl. No.: 14/782,764

(22) PCT Filed: Apr. 28, 2014

(86) PCT No.: PCT/JP2014/061814

§ 371 (c)(1),
(2) Date: Oct. 6, 2015

(87) PCT Pub. No.: WO2014/178359

PCT Pub. Date: Nov. 6, 2014

(65) Prior Publication Data

US 2016/0040273 A1 Feb. 11, 2016

(30) Foreign Application Priority Data

May 1, 2013 (JP) ..... 2013-096428

(51) Int. Cl.
*C22C 38/00* (2006.01)
*C22C 38/02* (2006.01)
(Continued)

(52) U.S. Cl.
CPC ..... *C22C 38/28* (2013.01); *C21D 8/0436* (2013.01); *C21D 8/0473* (2013.01);
(Continued)

(58) Field of Classification Search
CPC ... C22C 38/001; C22C 38/002; C22C 38/005; C22C 38/28; C21D 8/0436; C21D 8/0473
See application file for complete search history.

(56) References Cited

U.S. PATENT DOCUMENTS

2004/0202889 A1 10/2004 Fujita et al.
2006/0231177 A1 10/2006 Bano et al.
(Continued)

FOREIGN PATENT DOCUMENTS

CN 1483090 A 3/2004
CN 101163811 A 4/2008
(Continued)

OTHER PUBLICATIONS

Extended European Search Report for European Application No. 14791416.2, dated Nov. 14, 2016.
(Continued)

*Primary Examiner* — Colin W. Slifka
(74) *Attorney, Agent, or Firm* — Birch, Stewart, Kolasch & Birch, LLP

(57) ABSTRACT

A steel sheet including, by mass %, C: more than 0.100% and 0.500% or less, Si: 0.0001% or more and less than 0.20%, Mn: more than 0.20% and 0.50% or less, Al: 3.0% or more and 10.0% or less, N: 0.0030% or more and 0.0100% or less, Ti: more than 0.100% and 1.000% or less, P: 0.00001% or more and 0.0200% or less, S: 0.00001% or more and 0.0100% or less, and a remainder including Fe and impurities, in which a sum of a C content and a Ti content satisfies $0.200<C+Ti\leq1.500$ by mass %, a product of an Al content and an Si content satisfies $Al\times Si\leq0.8$ by mass %, and a specific gravity is 5.5 to less than 7.5.

2 Claims, 1 Drawing Sheet

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/54*** | (2006.01) |
| ***C21D 8/04*** | (2006.01) |
| *C21D 9/46* | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/54* (2013.01); *C21D 8/0478* (2013.01); *C21D 9/46* (2013.01)

(56) References Cited

U.S. PATENT DOCUMENTS

| | | | |
|---|---|---|---|
| 2006/0269776 | A1 | 11/2006 | Tanaka et al. |
| 2006/0292391 | A1 | 12/2006 | Ikematsu et al. |
| 2009/0162691 | A1 | 6/2009 | Ishizuka et al. |
| 2010/0112377 | A1 | 5/2010 | Kaneko et al. |
| 2011/0287280 | A1 | 11/2011 | Shiraki et al. |
| 2014/0342183 | A1 | 11/2014 | Wakabayashi et al. |
| 2016/0040273 | A1 | 2/2016 | Oka et al. |

FOREIGN PATENT DOCUMENTS

| | | | |
|---|---|---|---|
| CN | 101646797 | A | 2/2010 |
| CN | 101736195 | A | 6/2010 |
| CN | 102260821 | A | 11/2011 |
| EP | 1 354 970 | A1 | 10/2003 |
| EP | 2 128 293 | A1 | 12/2009 |
| JP | 57-76176 | A | 5/1982 |
| JP | 3-226550 | A | 10/1991 |
| JP | 4-13855 | A | 1/1992 |
| JP | 4-147953 | A | 5/1992 |
| JP | 9-227997 | A | 9/1997 |
| JP | 2003-328088 | A | 11/2003 |
| JP | 2005-15909 | A | 1/2005 |
| JP | 2005-29889 | A | 2/2005 |
| JP | 2005-273004 | A | 10/2005 |
| JP | 2006-176843 | A | 7/2006 |
| JP | 2006-176844 | A | 7/2006 |
| JP | 2007-84913 | A | 4/2007 |
| JP | 2007-321168 | A | 12/2007 |
| JP | 2008-261023 | A | 10/2008 |
| JP | 2009-263780 | A | 11/2009 |
| JP | 2010-121209 | A | 6/2010 |
| JP | 2010-229538 | A | 10/2010 |
| JP | 2010-270377 | A | 12/2010 |
| JP | 2011-132602 | A | 7/2011 |
| RU | 2 312 162 | C2 | 12/2007 |
| RU | 2 312 920 | C2 | 12/2007 |
| RU | 2 323 983 | C2 | 5/2008 |
| RU | 2 418 094 | C2 | 5/2011 |
| TW | 200706693 | A | 2/2007 |
| TW | 200728474 | A | 8/2007 |
| WO | WO 2013/034317 | A1 | 3/2013 |
| WO | WO 2013/047830 | A1 | 4/2013 |

OTHER PUBLICATIONS

International Search Report, dated Jul. 8, 2014, issued in PCT/JP2014/061814.

Written Opinion of the International Searching Authority, dated Jul. 8, 2014, issued in PCT/JP2014/061814.

Chinese Office Action and Chinese Search Report, dated May 26, 2016, for Chinese Application No. 201480022843.X, along with English translation.

Chinese Decison of Rejection dated Mar. 27, 2017, issued in Chinese Patent Application No. 201480022843.X.

European Office Action, dated Jul. 3, 2017 for corresponding European Application No. 14791416.2.

Chinese Office Action and Search Report with the English translation issued in corresponding Chinese Application No. 201480024752.X, dated Jun. 20, 2016.

International Search Report issued in PCT/JP2014/061813, dated Jul. 8, 2014.

Japanese language Written Opinion of the International Searching Authority, issued in PCT/JP2014/061813, dated Jul. 8, 2014.

Japanese Notice of Reasons for Rejection with the English translation, issued in correponding Japanese Application No. 2015-514837, dated Nov. 29, 2016.

Korean Office Action with the English translation, issued in corresponding Korean Application No. 10-2015-7030723, dated Aug. 26, 2016.

Russian Office Action and Seach Report with the English translation, issued in corresponding Russian Application No. 2015147307, dated Feb. 16, 2017.

Tawainese Office Action issued in corresponding Tawainese Application No. 103115152, dated Apr. 13, 2015.

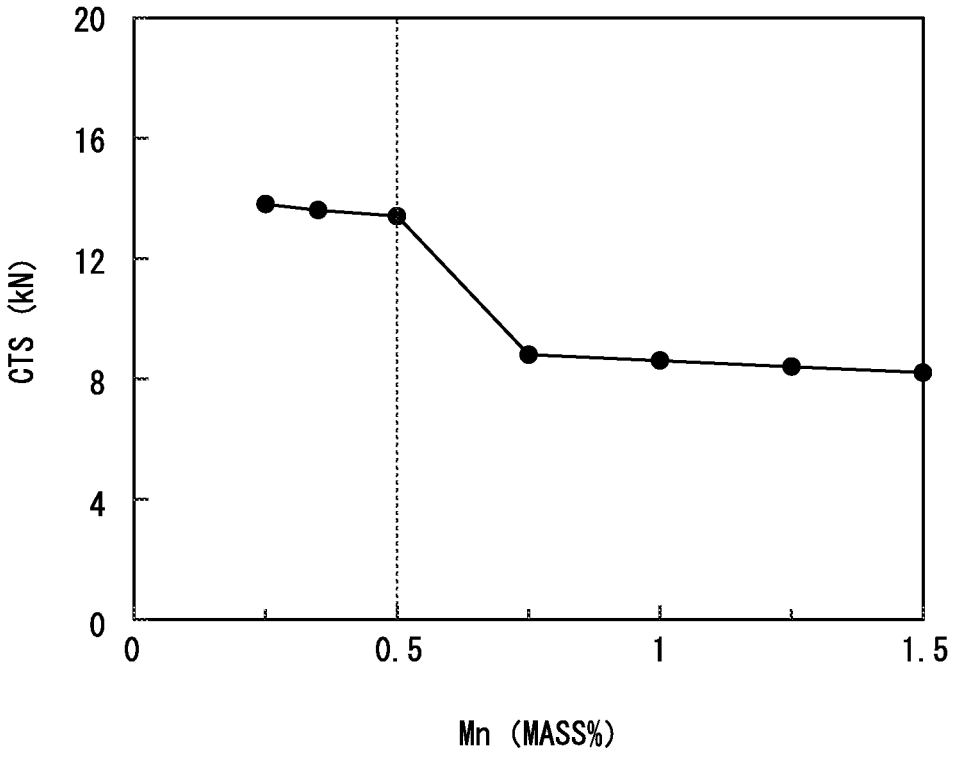
20
16
12
8
4
0
CTS (kN)
0
0.5
1
1.5
Mn (MASS%)

HIGH-STRENGTH LOW-SPECIFIC-GRAVITY STEEL SHEET HAVING SUPERIOR SPOT WELDABILITY

TECHNICAL FIELD OF THE INVENTION

The present invention relates to a high-strength low-specific-gravity steel sheet having superior spot weldability which is used for an automobile component or the like.

Priority is claimed on Japanese Patent Application No. 2013-96428, filed on May 1, 2013, the content of which is incorporated herein by reference.

RELATED ART

Recently, as a countermeasure against environmental problems, reduction in the weight of a vehicle has been desired in order to reduce carbon dioxide emissions and fuel consumption. In order to reduce the weight of a vehicle, high-strengthening of steel is an effective means. However, when the lower limit of the thickness of a steel sheet is limited due to rigidity required for a component, the thickness of the steel sheet cannot be reduced even after high-strengthening of steel, and it is difficult to reduce the weight of a vehicle.

Therefore, for example, as disclosed in Patent Documents 1 to 5, some of the present inventors proposed a high Al-content steel sheet in which the specific gravity is reduced by adding a large amount of Al to steel. In the high Al-content steel sheets disclosed in Patent Documents 1 to 5, problems of a high Al-content steel sheet of the related art including poor producibility such as cracking, which may occur during rolling, and low ductility are solved. Further, in order to improve ductility, hot workability, and cold workability of a high Al-content steel sheet, for example, as disclosed in Patent Document 6, the present inventors proposed a method of adjusting a solidification structure after casting to be a fine equiaxed structure. Further, for example, as disclosed in Patent Document 7, the present inventors proposed a method of improving toughness of a high Al-content steel sheet by optimizing components.

PRIOR ART DOCUMENT

Patent Document

[Patent Document 1] Japanese Unexamined Patent Application, First Publication No. 2005-15909

[Patent Document 2] Japanese Unexamined Patent Application, First Publication No. 2005-29889

[Patent Document 3] Japanese Unexamined Patent Application, First Publication No. 2005-273004

[Patent Document 4] Japanese Unexamined Patent Application, First Publication No. 2006-176843

[Patent Document 5] Japanese Unexamined Patent Application, First Publication No. 2006-176844

[Patent Document 6] Japanese Unexamined Patent Application, First Publication No. 2008-261023

[Patent Document 7] Japanese Unexamined Patent Application, First Publication No. 2010-270377

DISCLOSURE OF THE INVENTION

Problems to be Solved by the Invention

Recently, a high Al-content steel sheet having superior ductility, workability, and toughness has been able to be produced on an industrial scale. The high Al-content steel sheet has, for example, superior arc weldability. However, the spot weldability of the high Al-content steel sheet is lower than that of a general automobile steel sheet having the same strength, and thus the use of the high Al-content steel sheet is limited. Accordingly, the improvement of spot weldability is an important issue to increase the application range of the high Al-content steel sheet to automobile components.

The present invention has been made in consideration of the above-described actual circumstances, and an object thereof is to provide a high-strength low-specific-gravity steel sheet having superior spot weldability which is obtained by improving the spot weldability of a low-specific-gravity steel sheet to which Al is added.

Means for Solving the Problem

In order to improve the spot weldability of a high Al-content steel sheet, the present inventors investigated elements which decrease spot weldability. As a result, the present inventors found the following facts: that the spot weldability of a high Al-content steel sheet is greatly affected by the Mn content in the high Al-content steel sheet; and that the spot weldability of a high Al-content steel sheet can be significantly improved by reducing the Mn content in the high Al-content steel sheet.

The summary of the present invention is as follows.

(1) According to an aspect of the present invention, there is provided a steel sheet including, by mass %, C: more than 0.100% and 0.500% or less, Si: 0.0001% or more and less than 0.20%, Mn: more than 0.20% and 0.50% or less, Al: 3.0% or more and 10.0% or less, N: 0.0030% or more and 0.0100% or less, Ti: more than 0.100% and 1.000% or less, P: 0.00001% or more and 0.0200% or less, S: 0.00001% or more and 0.0100% or less, and a remainder including Fe and impurities, in which a sum of a C content and a Ti content satisfies $0.200<C+Ti\leq1.500$ by mass %, a product of an Al content and an Si content satisfies $Al\times Si\leq0.8$ by mass %, and a specific gravity is 5.5 to less than 7.5.

(2) The steel sheet according to (1) may further include one element or two or more elements selected from the group consisting of, by mass %, Nb: 0.300% or less, V: 0.50% or less, Cr: 3.00% or less, Mo: 3.00% or less, Ni: 5.00% or less, Cu: 3.00% or less, B: 0.0100% or less, Ca: 0.0100% or less, Mg: 0.0100% or less, Zr: 0.0500% or less, and REM: 0.0500% or less.

Effects of the Invention

According to the above-described aspects, a high-strength low-specific-gravity steel sheet having high producibility and superior spot weldability can be obtained, which remarkably contributes to the industry.

BRIEF DESCRIPTION OF THE DRAWING

FIG. 1 is diagram showing a relationship between the Mn content in a high-strength low-specific-gravity steel sheet and the cross tension strength (CTS) of a resistance spot welded joint.

EMBODIMENTS OF THE INVENTION

The present inventors performed investigations in order to improve the spot weldability of a high Al-content steel sheet. Specifically, the present inventors produced a hot-rolled steel sheet and a cold-rolled steel sheet using various kinds of steel having different amounts of alloy elements in the chemical composition of the above-described high-strength low-specific-gravity steel sheet disclosed in Patent Document 7 having superior ductility, workability, and toughness. Using these steel sheets, spot weldability was evaluated. The tension strengths of the obtained steel sheets were about 500 MPa, the thickness of the hot-rolled steel sheet was 2.3 mm, and the thickness of the cold-rolled steel sheet was 1.2 mm. The spot weldability was evaluated based on the cross tension strength of a resistance spot welded joint which was obtained in a tension test according to JIS Z 3137. In addition, spot welding was performed using an ordinary spot welding machine under welding conditions which were adjusted such that a nugget diameter was $5\times\sqrt{t}$ (mm) at a sheet thickness oft. FIG. 1 shows the effect of the Mn content in the hot-rolled steel sheet on the cross tension strength (CTS) of the steel sheet. It was found that, by adjusting the Mn content in the steel sheet to be 0.5 mass % or less as shown in FIG. 1, the CTS can be significantly improved. In the case of the cold-rolled steel sheet, as in the case of the hot-rolled steel sheet, it was found that by adjusting the Mn content in the steel sheet to be 0.5 mass % or less, the CTS can be significantly improved.

Next, the reason for limiting the chemical composition of a high-strength low-specific-gravity steel sheet according to an embodiment of the present invention having superior spot weldability will be described. "%" represents "mass %".

C: More than 0.100% and 0.500% or Less

C is an essential element for adjusting a solidification structure to be a fine equiaxed structure. Therefore, the C content is more than 0.100%. On the other hand, when the C content is more than 0.500%, the toughness and arc weldability of the steel sheet deteriorate. Accordingly, the C content is more than 0.100% and 0.500% or less. The lower limit of the C content is preferably 0.150%, more preferably 0.200%, and still more preferably 0.250%. The upper limit of the C content is preferably 0.400%, more preferably 0.300%, and still more preferably 0.200%.

Ti: More than 0.100% and 1.000% or Less

Ti is an essential element for adjusting a solidification structure to be a fine equiaxed structure. Therefore, the Ti content is more than 0.100%. On the other hand, when the Ti content is more than 1.000%, the toughness of the steel sheet decreases. Accordingly, the Ti content is more than 0.100% and 1.000% or less. In order to obtain a finer equiaxed structure, the lower limit of the Ti content is preferably 0.300%, more preferably 0.350%, and still more preferably 0.400%. The upper limit of the Ti content is preferably 0.900%, more preferably 0.800%, and still more preferably 0.700%.

$0.200\%<C+Ti<1.500\%$

In order to adjust the solidification structure to be a finer equiaxed structure, the sum of the C content and the Ti content, that is, C+Ti is more than 0.200% and 1.500% or less. The lower limit of C+Ti is preferably 0.300%, more preferably 0.400%, and still more preferably 0.500%. The upper limit of C+Ti is preferably 1.300%, more preferably 1.200%, and still more preferably 1.000%.

Al: 3.0% or More and 10.0% or Less

Al is an essential element for achieving the low-specific-gravity of the steel sheet. When the Al content is less than 3.0%, the low-specific-gravity effect is insufficient, and the specific gravity cannot be reduced to be less than 7.5. On the other hand, when the Al content is more than 10.0%, the precipitation of an intermetallic compound is significant, and ductility, workability, and toughness decrease. Accordingly, the Al content is 3.0% or more and 10.0% or less. In order to obtain superior ductility, the upper limit of the Al content is preferably 6.0%, more preferably 5.5%, and still more preferably 5.0%. In order to desirably obtain the low-specific-gravity effect, the lower limit of the Al content is preferably 3.5%, more preferably 3.7%, and still more preferably 4.0%.

Si: 0.0001% or More and Less than 0.20%

Si is an element which decreases the toughness of the steel sheet, and it is necessary to reduce the Si content in the steel sheet. Therefore, the upper limit of the Si content is less than 0.20% and is preferably 0.15%. On the other hand, the lower limit of the Si content is 0.0001% in consideration of the current refining techniques and the production cost.

$Al\times Si\leq 0.8$

The product of the Al content and the Si content, that is, Al×Si is 0.8 or less, preferably 0.7 or less, and more preferably 0.6 or less. As a result, far superior toughness can be obtained. It is preferable that Al×Si is reduced to be as small as possible. Although not particularly limited, the lower limit of Al×Si is preferably 0.03 in consideration of the refining technique and the production cost.

Mn: More than 0.20% and 0.50% or Less

Mn is an effective element for forming MnS to suppress grain boundary embrittlement caused by solid solution S. However, when the Mn content is 0.20% or less, the effect is not exhibited. On the other hand, when the Mn content is more than 0.50%, the spot weldability decreases. Accordingly, the Mn content is more than 0.20% and 0.50% or less. The lower limit of the Mn content is preferably 0.22%, more preferably 0.24%, and still more preferably 0.26%. The upper limit of the Mn content is preferably 0.40%, more preferably 0.35%, and still more preferably 0.30%.

P: 0.00001% or More and 0.0200% or Less

P is an impurity element which is segregated in a grain boundary to decrease the grain boundary strength and the toughness and weldability of the steel sheet, and it is preferable to reduce the P content in the steel sheet. Therefore, the upper limit of the P content is 0.0200%. In addition, the lower limit of the P content is 0.00001% in consideration of the current refining techniques and the production cost. However, in order to obtain more superior weldability, the upper limit of the P content is preferably 0.0050%, more preferably 0.0040%, and still more preferably 0.0030%.

$Mn+100\times P\leq 1.0$

By setting the Mn content and the P content to satisfy $Mn+100\times P\leq 1.0$, superior spot weldability can be obtained. When $Mn+100\times P$ is excessively low, grain boundary embrittlement occurs. Therefore, the lower limit of $Mn+100\times P$ is preferably 0.2.

S: 0.00001% or More and 0.0100% or Less

S is an impurity element which decreases the hot workability and toughness of the steel sheet, and it is preferable to reduce the S content in the steel sheet. Therefore, the upper limit of the S content is 0.0100%. The upper limit of the S content is preferably 0.0080%, more preferably 0.0065%, and still more preferably 0.0050%. In addition, the lower limit of the S content is 0.00001% in consideration of the current refining techniques and the production cost.

N: 0.0030% or More and 0.0100% or Less

N is an essential element for forming a nitride and/or carbon nitride with Ti, that is, TiN and Ti(C,N) to adjust the solidification structure to be a fine equiaxed structure. This effect is not exhibited when the N content is less than 0.0030%. In addition, when the N content is more than 0.0100%, toughness decreases due to the production of coarse TiN. Accordingly, the N content is 0.0030% or more and 0.0100% or less. The lower limit of the N content is preferably 0.0035%, more preferably 0.0040%, and still more preferably 0.0045%. The upper limit of the N content is preferably 0.0080%, more preferably 0.0065%, and still more preferably 0.0050%.

The above-described elements are basic components of the steel sheet according to the embodiment, and a remainder other than the above-described elements includes Fe and unavoidable impurities. However, depending on the desired strength level and other required characteristics, one element or two or more elements of Nb, V, Cr, Ni, Mo, Cu, B, Ca, Mg, Zr, and REM may be added to the steel sheet according to the embodiment instead of a part of Fe in the remainder.

Nb: 0.300% or Less

Nb is an element for forming a fine carbon nitride and is effective to suppress the coarsening of crystal grains. In order to improve the toughness of the steel sheet, it is preferable to add 0.005% or more of Nb. However, when an excess amount of Nb is added, a precipitate is coarsened, and the toughness of the steel sheet may decrease. Accordingly, the Nb content is preferably 0.300% or less.

V: 0.50% or Less

Like Nb, V is an element which forms a fine carbon nitride. In order to suppress the coarsening of crystal grains and to improve the toughness of the steel sheet, it is preferable to add 0.01% or more of V. When the V content is more than 0.50%, toughness may decrease. Therefore, the upper limit of the V content is preferably 0.50%.

Cr: 3.00% or Less

Mo: 3.00% or Less

Ni: 5.00% or Less

Cu: 3.00% or Less

Cr, Mo, Ni, and Cu are effective elements for improving the ductility and toughness of the steel sheet. However, when each of the Cr content, the Mo content, and the Cu content is more than 3.00%, toughness may deteriorate along with an increase in strength. In addition, when the Ni content is more than 5.00%, toughness may deteriorate along with an increase in strength. Accordingly, the upper limit of the Cr content is preferably 3.00%, the upper limit of the Mo content is preferably 3.00%, the upper limit of the Ni content is preferably 5.00%, and the upper limit of the Cu content is preferably 3.00%. In addition, in order to improve the ductility and toughness of the steel sheet, the Cr content is preferably 0.05% or more, the Mo content is preferably 0.05% or more, the Ni content is preferably 0.05% or more, and the Cu content is preferably 0.10% or more.

B: 0.0100% or Less

B is an element which is segregated in a grain boundary to suppress the grain boundary segregation of P and S. However, when the B content is more than 0.0100%, a precipitate is produced, and hot workability may deteriorate. Accordingly, the B content is 0.0100% or less. The B content is more preferably 0.0020% or less. In order to improve the ductility, toughness, and hot workability of the steel sheet through grain boundary strengthening, the B content is preferably 0.0003% or more.

Like P, B is an element which is likely to be segregated in a grain boundary. In order to obtain an effect of suppressing grain boundary corrosion, the total content of P and B is preferably 0.0050% or less and more preferably 0.0045% or less. The lower limit of the total content of P and B is preferably 0.00001% and more preferably 0.0004% from the viewpoint of dephosphorization cost.

Ca: 0.0100% or Less

Mg: 0.0100% or Less

Zr: 0.0500% or Less

REM: 0.0500% or Less.

Ca, Mg, Zr, and REM are effective elements for controlling the form of a sulfide to suppress deterioration in the hot workability and toughness of the steel sheet caused by S. However, when excess amounts of the elements are added, the effect is saturated. Therefore, the Ca content is preferably 0.0100% or less, the Mg content is preferably 0.0100% or less, the Zr content is preferably 0.0500% or less, and the REM content is preferably 0.0500% or less. In addition, in order to improve the toughness of the steel sheet, the Ca content is preferably 0.0010% or more, the Mg content is preferably 0.0005% or more, the Zr content is preferably 0.0010% or more, and the REM content is preferably 0.0010% or more.

Next, characteristics of the high-strength low-specific-gravity steel sheet according to the embodiment will be described.

When the specific gravity of the steel sheet is 7.5 or more, the weight reduction effect is lower as compared to with the specific gravity (equivalent to 7.86 which is the specific gravity of iron) of a steel sheet which is typically used as an automobile steel sheet. Therefore, the specific gravity of the steel sheet is less than 7.5. The specific gravity of the steel sheet is determined according to the component composition, and it is preferable to increase the Al content contributing to the weight reduction. The lower limit of the specific gravity of the steel sheet is not particularly limited. However, in the component composition of the steel sheet according to the embodiment, it is difficult to set the specific gravity to be less than 5.5. Therefore, the lower limit of the specific gravity is 5.5.

Regarding the tension strength and ductility of the steel sheet, in consideration of characteristics required for an automobile steel sheet, the tension strength is preferably 440 MPa or higher, and the elongation is preferably 25% or higher.

Next, a method for producing the steel sheet according to the embodiment will be described.

In the embodiment, steel having the above-described chemical composition is cast at a molten steel superheat degree of 50° C. or lower, and the obtained billet is hot-rolled. Further, mechanical descaling, pickling, cold rolling, or annealing may be performed. The unit of the temperature such as molten steel superheat degree, liquidus temperature, or molten steel temperature is degrees Celsius.

The molten steel superheat degree is a value obtained by subtracting the molten steel temperature during casting from the liquidus temperature obtained from the chemical composition, that is, "Molten Steel Superheat Degree=Molten Steel Temperature−Liquidus Temperature".

When the molten steel superheat degree is higher than 50° C., TiN or Ti(C,N) crystallized in the liquid aggregates and is coarsened. Therefore, TiN or Ti(C,N) crystallized in the liquid phase does not efficiently function as solidification nuclei of ferrite. Even when the chemical composition of the molten steel according to the embodiment is in the above-described defined range, the solidification structure may be a columnar grain structure. Accordingly, the molten steel superheat degree is preferably 50° C. or lower. Although not limited, the lower limit of the molten steel superheat degree is typically 10° C.

When the heating temperature of the billet in the hot-rolling process is lower than 1100° C., a carbon nitride is not sufficiently solid-soluted, and necessary strength and ductility may not be obtained. Accordingly, the lower limit of the heating temperature is preferably 1100° C. The upper limit of the heating temperature is not particularly limited. However, when the heating temperature is higher than 1250° C., the grain size of crystal grains increases, and hot workability may decrease. Therefore, the upper limit of the heating temperature is preferably 1250° C.

When the finish rolling temperature is lower than 800° C., hot workability decreases, and cracking may occur during hot rolling. Accordingly, the lower limit of the finish rolling temperature is preferably 800° C. The upper limit of the finish rolling temperature is not particularly limited. However, when the finish rolling temperature is higher than 1000° C., the grain size of crystal grains increases, and cracking may occur during cold rolling. Therefore, the upper limit of the finish rolling temperature is preferably 1000° C.

When the coiling temperature is lower than 600° C., the recovery and recrystallization of ferrite is insufficient, and the workability of the steel sheet may deteriorate. Accordingly, the lower limit of the coiling temperature is preferably 600° C. On the other hand, when the coiling temperature is higher than 750° C., crystal grains of recrystallized ferrite are coarsened, and the ductility, hot workability, and cold workability of the steel sheet may decrease. Accordingly, the upper limit of the coiling temperature is preferably 750° C.

In order to remove scale produced during hot rolling, for example, mechanical descaling using, for example, a tension leveler and/or pickling may be performed.

In order to improve the ductility of the hot-rolled steel sheet, annealing may be performed after hot rolling. In order to the form of a precipitate to improve ductility, the annealing temperature of the hot-rolled steel sheet is preferably 700° C. or higher. In addition, when the annealing temperature of the hot-rolled steel sheet is higher than 1100° C., crystal grains are coarsened, and grain boundary embrittlement may be promoted. Accordingly, the upper limit of the annealing temperature of the hot-rolled steel sheet is preferably 1100° C.

In order to remove scale after annealing the hot-rolled steel sheet, mechanical descaling and/or pickling may be performed.

The hot-rolled steel sheet may be cold-rolled and annealed to produce a cold-rolled steel sheet. Hereinafter, preferable production conditions of the cold-rolled steel sheet will be described.

The cold-rolling reduction during cold rolling is preferably 20% or higher from the viewpoint of productivity. In addition, in order to promote recrystallization during annealing after cold rolling, the cold-rolling reduction is preferably 50% or higher. In addition, when the cold-rolling reduction is higher than 95%, cracking may occur during cold rolling. Accordingly, the upper limit of the cold-rolling reduction is preferably 95%.

The annealing temperature after cold rolling is preferably 600° C. or higher in order to sufficiently promote recrystallization and recovery. On the other hand, when the annealing temperature after cold rolling is higher than 1100° C., crystal grains are coarsened, and grain boundary embrittlement may be promoted. Accordingly, the upper limit of the annealing temperature of the cold-rolled steel sheet is preferably 1100° C.

The cooling rate after the annealing of the cold-rolled steel sheet is preferably 20° C./s or faster, and the cooling stop temperature is preferably 450° C. or lower. This is to prevent grain boundary embrittlement, which is caused by the coarsening of crystal grains due to grain growth during cooling and by the segregation of an impurity element such as P in a grain boundary, and to improve ductility. Although not limited, it is technically difficult to set the upper limit of the cooling rate to be faster than 500° C./sec. In addition, since the lower limit of the cooling stop temperature depends on the temperature of a cooling medium, it is difficult to set the lower limit of the cooling stop temperature to be lower than room temperature.

In order to remove scale produced after cold rolling and annealing, mechanical descaling and/or pickling may be performed. In addition, after cold rolling and annealing, temper-rolling may be performed to correct the shape and to eliminate elongation at yield. During temper-rolling, when the elongation ratio is lower than 0.2%, the effect is not sufficient. When the elongation ratio is higher than 2%, a yield ratio significantly increases, and elongation deteriorates. Accordingly, the elongation ratio during temper-rolling is 0.2% or higher and preferably 2% or lower.

EXAMPLES

Hereinafter, the technical content of the present invention will be described in detail using examples of the present invention.

Example 1

Steel having a chemical composition shown in Table 1 was cast at a molten steel superheat degree of 40° C. and was hot-rolled under conditions shown in Table 2. The thickness of the steel sheet was 2.3 mm.

The specific gravity, mechanical properties, arc weldability, and spot weldability of the obtained hot-rolled steel sheet were evaluated. The specific gravity of the steel sheet was measured using a pycnometer. The mechanical properties were evaluated by performing a tension test according to JIS Z 2241 to measure the tension strength (TS). The arc weldability of the steel sheet was evaluated by preparing a lap fillet welded joint through Pulse-MAG welding and performing a tension test according to JIS Z 2241 to measure a welded joint tension strength. As a weld wire, weld wire for soft steel and a 490 N/mm$^2$-class high tensile strength steel plate was used. As a shielding gas, Ar+20% $CO_2$ gas was used. The spot weldability of the steel sheet was evaluated based on the cross tension strength of a resistance spot welded joint according to JIS Z 3137. Spot welding was performed using an ordinary spot welding machine under welding conditions which were adjusted such that a nugget diameter was $5\times\sqrt{t}$ at a sheet thickness oft (mm).

Table 2 shows the evaluation results of the specific gravity, tension strength, arc welded joint tension strength, and CTS of the steel sheet. A CTS of 12 kN or higher was evaluated as "Good" in consideration of the thickness and tension strength level of the steel sheet. In the evaluation items, a value which was evaluated as "Poor" is underlined.

Hot-Rolling Nos. 1 to 8 were examples according to the present invention, in which all the characteristics were evaluated as "Good", and a steel sheet having desired characteristics was obtained. On the other hand, in Hot-Rolling Nos. 9 to 13 in which the chemical composition was not in the range of the present invention, the arc welded joint strength was high and equivalent to the strength of the base material, but the CTS was "Poor" at lower than 12 kN.

TABLE 1

| | Chemical Composition (mass %) | | | | | | | | | | | | | | | |
|---|---|---|---|---|---|---|---|---|---|---|---|---|---|---|---|---|
| Steel No. | C | Si | Mn | P | S | Al | N | Ti | Nb | V | Cr, Mo, Ni, Cu | B | Ca, Mg, REM, Zr | C + Ti | Al × Si | Note |
| A | 0.115 | 0.03 | 0.32 | 0.0048 | 0.0016 | 4.3 | 0.0032 | 0.413 | | | | | | 0.528 | 0.129 | Examples |
| B | 0.109 | 0.05 | 0.21 | 0.0042 | 0.0018 | 4.4 | 0.0053 | 0.396 | 0.02 | | | | | 0.505 | 0.220 | According |

TABLE 1-continued

| Steel No. | Chemical Composition (mass %) C | Si | Mn | P | S | Al | N | Ti | Nb | V | Cr, Mo, Ni, Cu | B | Ca, Mg, REM, Zr | C + Ti | Al × Si | Note |
|---|---|---|---|---|---|---|---|---|---|---|---|---|---|---|---|---|
| C | 0.127 | 0.07 | 0.48 | 0.0035 | 0.0032 | 4.8 | 0.0042 | 0.352 | | | Cr: 0.20 | | | 0.479 | 0.336 | to Present |
| D | 0.143 | 0.04 | 0.35 | 0.0046 | 0.0025 | 4.5 | 0.0061 | 0.401 | | | | 0.0013 | | 0.544 | 0.180 | Invention |
| E | 0.211 | 0.08 | 0.27 | 0.0038 | 0.0008 | 5.6 | 0.0045 | 0.516 | 0.01 | 0.13 | | | Mg: 0.0028 | 0.727 | 0.448 | |
| F | 0.174 | 0.05 | 0.44 | 0.0027 | 0.0017 | 7.5 | 0.0068 | 0.362 | | | Ni: 0.10, Cu: 0.20 | | REM: 0.0042 | 0.536 | 0.375 | |
| G | 0.315 | 0.07 | 0.38 | 0.0049 | 0.0025 | 6.3 | 0.0051 | 0.452 | | | Mo: 0.10 | | Ca: 0.0031 | 0.767 | 0.441 | |
| H | 0.126 | 0.12 | 0.42 | 0.0032 | 0.0015 | 4.2 | 0.0038 | 0.163 | | | | 0.0016 | Zr: 0.0117 | 0.289 | 0.504 | |
| I | 0.107 | 0.02 | 1.45 | 0.0092 | 0.0019 | 4.5 | 0.0058 | 0.402 | | | | | | 0.509 | 0.090 | Comparative |
| J | 0.114 | 0.03 | 1.28 | 0.0073 | 0.0015 | 4.2 | 0.0045 | 0.382 | 0.02 | | | | | 0.496 | 0.126 | Example |
| K | 0.121 | 0.05 | 1.53 | 0.0085 | 0.0027 | 4.7 | 0.0037 | 0.347 | | | Cr: 0.2 | | | 0.468 | 0.235 | |
| L | 0.156 | 0.04 | 1.16 | 0.0126 | 0.0018 | 4.4 | 0.0063 | 0.415 | | | | 0.0012 | | 0.571 | 0.176 | |
| M | 0.185 | 0.02 | 1.85 | 0.0068 | 0.0023 | 7.7 | 0.0072 | 0.345 | | | Ni: 0.10, Cu: 0.20 | | REM: 0.0048 | 0.530 | 0.154 | |

(Note)
Underlined values were not in the range of the present invention

TABLE 2

| Hot-Rolling No. | Steel No. | Hot-Rolling Conditions: Heating Temperature (° C.) | Finish Temperature (° C.) | Coiling Temperature (° C.) | Specific Gravity | Mechanical Properties: Tension Strength (MPa) | Arc Weldability: Welded Joint Tension Strength (MPa) | Spot Weldability CTS (kN) | Note |
|---|---|---|---|---|---|---|---|---|---|
| 1 | A | 1160 | 840 | 720 | 7.29 | 460 | 465 | 14.1 | Examples According to Present Invention |
| 2 | B | 1150 | 870 | 700 | 7.28 | 442 | 448 | 13.5 | |
| 3 | C | 1170 | 860 | 710 | 7.24 | 473 | 478 | 14.6 | |
| 4 | D | 1160 | 850 | 690 | 7.27 | 456 | 462 | 13.9 | |
| 5 | E | 1220 | 880 | 740 | 7.10 | 510 | 515 | 13.3 | |
| 6 | F | 1120 | 830 | 630 | 6.99 | 532 | 538 | 14.0 | |
| 7 | G | 1180 | 860 | 660 | 7.10 | 536 | 541 | 14.8 | |
| 8 | H | 1130 | 840 | 700 | 7.29 | 473 | 478 | 14.5 | |
| 9 | I | 1150 | 850 | 700 | 7.27 | 484 | 487 | 9.1 | Comparative Example |
| 10 | J | 1170 | 880 | 720 | 7.30 | 465 | 469 | 9.0 | |
| 11 | K | 1160 | 850 | 700 | 7.25 | 496 | 499 | 9.7 | |
| 12 | L | 1150 | 840 | 710 | 7.28 | 475 | 479 | 9.2 | |
| 13 | M | 1150 | 850 | 700 | 6.97 | 562 | 565 | 9.3 | |

(Note)
Underlined steels in Steel No. were not in the range of the present invention, and underlined values in CTS were not in the preferable range.

Example 2

Steel having a chemical composition shown in Table 1 was cast at a molten steel superheat degree of 40° C. and was hot-rolled under conditions shown in Table 2. Next, the hot-rolled steel sheet was cold-rolled and annealed under conditions shown in Table 3. The thickness of the steel sheet was 1.2 mm.

As in the case of Example 1, the specific gravity, mechanical properties, arc weldability, and spot weldability of the obtained cold-rolled steel sheet were evaluated.

Table 3 shows the evaluation results of the specific gravity, tension strength, arc welded joint tension strength, and CTS of the steel sheet. A CTS of 7 kN or higher was evaluated as "Good" in consideration of the thickness and tension strength level of the steel sheet. In the evaluation items, a value which was evaluated as "Poor" is underlined.

Cold-Rolling Nos. 1 to 8 were examples according to the present invention, in which all the characteristics were evaluated as "Good", and a steel sheet having desired characteristics was obtained. On the other hand, in Cold-Rolling Nos. 9 to 13 in which the chemical composition was not in the range of the present invention, the arc welded joint strength was high and equivalent to the strength of the base material, but the CTS was "Poor" at lower than 7 kN.

TABLE 3

| Cold-Rolling No. | Steel No. | Hot-Rolling No. | Cold Rolling Conditions: Cold-Rolling Reduction | Cold-Rolled Steel Sheet Annealing Conditions: Annealing Temperature (° C.) | Cooling Rate (° C./sec) | Cooling Stop Temperature (° C.) | Specific Gravity | Mechanical Properties: Tension Strength (MPa) | Arc Weldability Welded Joint: Tension Strength (MPa) | Spot Weldability CTS (kN) | Note |
|---|---|---|---|---|---|---|---|---|---|---|---|
| 1 | A | 1 | 50 | 820 | 60 | 25 | 7.29 | 492 | 498 | 8.0 | Examples |
| 2 | B | 2 | 50 | 860 | 50 | 50 | 7.28 | 474 | 479 | 7.8 | According to |

TABLE 3-continued

| Cold-Rolling No. | Steel No. | Hot-Rolling No. | Cold Rolling Conditions: Cold-Rolling Reduction | Cold-Rolled Steel Sheet Annealing Conditions: Annealing Temperature (° C.) | Cooling Rate (° C./sec) | Cooling Stop Temperature (° C.) | Specific Gravity | Mechanical Properties: Tension Strength (MPa) | Arc Weldability Welded Joint: Tension Strength (MPa) | Spot Weldability CTS (kN) | Note |
|---|---|---|---|---|---|---|---|---|---|---|---|
| 3 | C | 3 | 50 | 850 | 70 | 25 | 7.24 | 505 | 511 | 8.2 | Present |
| 4 | D | 4 | 50 | 840 | 80 | 35 | 7.27 | 489 | 494 | 8.0 | Invention |
| 5 | E | 5 | 50 | 870 | 50 | 40 | 7.10 | 542 | 548 | 7.7 | |
| 6 | F | 6 | 50 | 850 | 60 | 25 | 6.99 | 565 | 571 | 8.1 | |
| 7 | G | 7 | 50 | 900 | 70 | 50 | 7.10 | 568 | 573 | 8.4 | |
| 8 | H | 8 | 50 | 840 | 80 | 60 | 7.29 | 505 | 510 | 8.3 | |
| 9 | I | 9 | 50 | 840 | 50 | 25 | 7.27 | 518 | 522 | 5.6 | Comparative |
| 10 | J | 10 | 50 | 850 | 70 | 35 | 7.30 | 500 | 503 | 5.5 | Example |
| 11 | K | 11 | 50 | 860 | 60 | 25 | 7.25 | 530 | 534 | 5.8 | |
| 12 | L | 12 | 50 | 850 | 50 | 40 | 7.28 | 510 | 513 | 5.5 | |
| 13 | M | 13 | 50 | 860 | 60 | 25 | 6.97 | 596 | 599 | 5.6 | |

(Note)
Underlined steels in Steel No. were not in the range of the present invention, and underlined values in CTS were not in the preferable range.

INDUSTRIAL APPLICABILITY

According to the present invention, a high-strength low-specific-gravity steel sheet having high producibility and superior spot weldability can be obtained, which remarkably contributes to the industry.

The invention claimed is:

1. A steel sheet comprising, by mass %,
C: more than 0.100% and 0.500% or less,
Si: 0.0001% or more and less than 0.20%,
Mn: more than 0.20% and 0.50% or less,
Al: 3.0% or more and 10.0% or less,
N: 0.0030% or more and 0.0100% or less,
Ti: more than 0.100% and 1.000% or less,
P: 0.00001% or more and 0.0200% or less,
S: 0.00001% or more and 0.0100% or less, and
a remainder including Fe and impurities,
wherein a sum of a C content and a Ti content satisfies $0.200<C+Ti\leq1.500$ by mass %,
a product of an Al content and an Si content satisfies $Al\times Si\leq0.8$ by mass %,
a Mn content and a P content satisfy $Mn+100\times P\leq1.0$, and
a specific gravity is 5.5 to less than 7.5.

2. The steel sheet according to claim 1, further comprising, one element or two or more elements selected from the group consisting of, by mass %,
Nb: 0.300% or less,
V: 0.50% or less,
Cr: 3.00% or less,
Mo: 3.00% or less,
Ni: 5.00% or less,
Cu: 3.00% or less,
B: 0.0100% or less,
Ca: 0.0100% or less,
Mg: 0.0100% or less,
Zr: 0.0500% or less, and
REM: 0.0500% or less.

* * * * *